US005842429A

United States Patent [19]

Gulotta

[11] Patent Number: 5,842,429

[45] Date of Patent: Dec. 1, 1998

[54] EMBROIDERY HOOP SUPPORT APPARATUS

[76] Inventor: David Gulotta, P.O. Box 9808, New Iberia, La. 70562

[21] Appl. No.: 735,739

[22] Filed: Oct. 23, 1996

[51] Int. Cl.[6] ..... D05C 09/04

[52] U.S. Cl. ..... 112/103; 112/475.18

[58] Field of Search ..... 112/103, 470.09, 112/470.14, 102, 470.18, 475.11, 260, 475.18

[56] References Cited

U.S. PATENT DOCUMENTS

| | | | |
|---|---|---|---|
| 508,315 | 11/1893 | Howell | 112/475.11 |
| 4,168,671 | 9/1979 | Roberts et al. | 112/260 X |
| 4,565,142 | 1/1986 | McGann | 112/260 |
| 4,665,844 | 5/1987 | Shibata | 112/103 |
| 5,501,163 | 3/1996 | Molder et al. | 112/102 |

*Primary Examiner*—Ismael Izaguirre
*Attorney, Agent, or Firm*—Robert N. Montgomery

[57] ABSTRACT

A hoop support attachment for a computerized embroidery sewing machine for adaptation to existing embroidery machines of a particular type not normally designed for tubular good embroidery and thereby improving sewing quality when used to embroidery designs directly onto tubular goods such as shirt sleeves, pants legs, sports bags etc. the attachment provides hoop support on all sides of the machine's needle plate thereby reducing needle drag, needle breakage and thus reducing nesting The hoop support is fitted with a removable extension member thereby providing elongated hoop support.

9 Claims, 2 Drawing Sheets

EMBROIDERY HOOP SUPPORT APPARATUS

BACKGROUND OF THE INVENTION

1. Field of the Invention

The present invention relates to computerized embroidery sewing equipment in general and more particular to an attachment apparatus for such equipment which improves stitch quality, and allows quick changeover from flat to tubular garments.

2. General Background

The embroidery industry has experienced phenomenal growth in recent years as a result of computerized embroidery sewing equipment. Such equipment now provides high quality embroidery at very reasonable rates thus allowing its use on a wide variety of piece goods. A great many customers are now requesting special embroidery designs placed directly on the products rather than on labels to be sewn to the goods. This is easily done with flat goods but is much more difficult with such products such as hats, jacket sleeves, sports bags, pants, brief cases etc. Therefore, special equipment is being designed to handle such goods having various adaptable components. However, in most cases such adaptations are only available with new equipment designed with this capability and must be purchased along with the adaptations. Therefore, there is a need for retrofit or accessories which allow existing equipment to perform such operations as well. Some of the most popular types of embroidery equipment such as that manufactured by Melco™ fails to provide adequate hoop support when used for tubular goods such as shirt sleeves, pants legs or sports bags. As a result the weight of the garment or bag pulls the hoop below the needle plate, putting stress on the hoop and carriage and occasionally causes the needle to hit the sides of the needle plate causing breakage It has also been observed that friction on the needle, resulting from the weight of the garment or cloth article being sewn, against the needle plate sometimes pulls the bobbin thread, "sandwiching" it between the cloth article and the needle plate thereby causing what is known in the industry as bird's nesting, thus lowering the quality of the embroidery stitch.

SUMMARY OF THE PRESENT INVENTION

The present invention address the retrofit of a particular type of electronic embroidery equipment such as that manufactured by Melco™ in such a manner as to provide adequate hoop support when the large table top, generally used for flat goods (items which can be opened up to lie flat on the table) is removed whereby the machine's sewing arms are exposed for use on tubular goods such as sleeves, pants legs or other cylindrical shaped cloth goods.

The present hoop support is an elongated shelf or plate, centrally slotted to be slidably adapted around the machine's needle and bobbin plate, thus providing a generally flat support area in all directions around the needle and bobbin plate, thereby providing sufficient support for the embroidery hoop. A lower support member, attached to the hoop support, is provided for stabilizing and securing the hoop support member to the machine. A provision is also made for extending the hoop support shelf or plate in a manner which will allow full support for elongated hoops.

Attachment of the hoop support is accomplished by simply removing the existing flat goods table portion from the machine, sliding the hoop support into place around the needle and bobbin plate and along the machine's sewing arm, inserting a retainer pin in the receiver normally used for inserting a cap frame and locking the pin in place with an existing thumbscrew. Multiple, hoop support attachments may also be utilized on machines having multiple sewing heads.

BRIEF DESCRIPTION OF THE DRAWINGS

For a further understanding of the nature and objects of the present invention, reference should be made to the following detailed description, taken in conjunction with the accompanying drawings, in which like parts are given like reference numerals, and wherein.

DESCRIPTION OF THE PREFERRED EMBODIMENT

Figure 1:
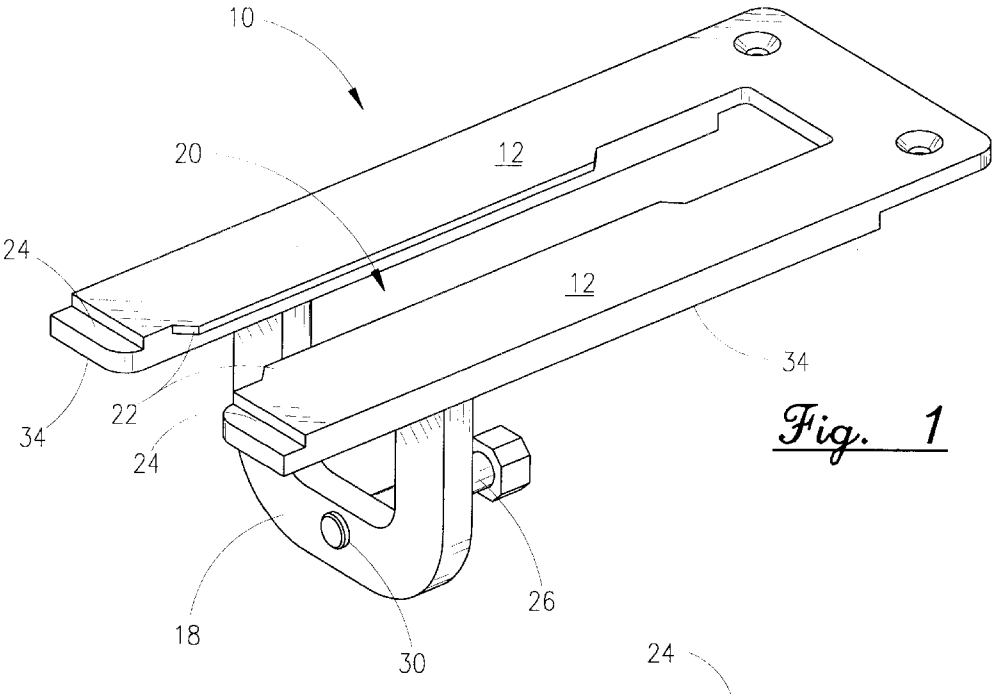
FIG. 1 is an isometric view of the invention.
Figure 2:
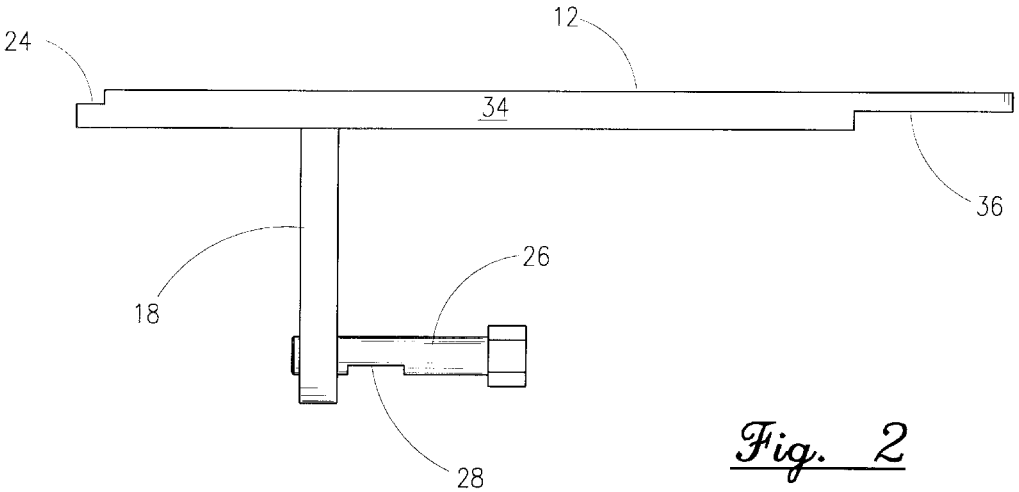
FIG. 2 is side elevation view of the invention.
Figure 3:
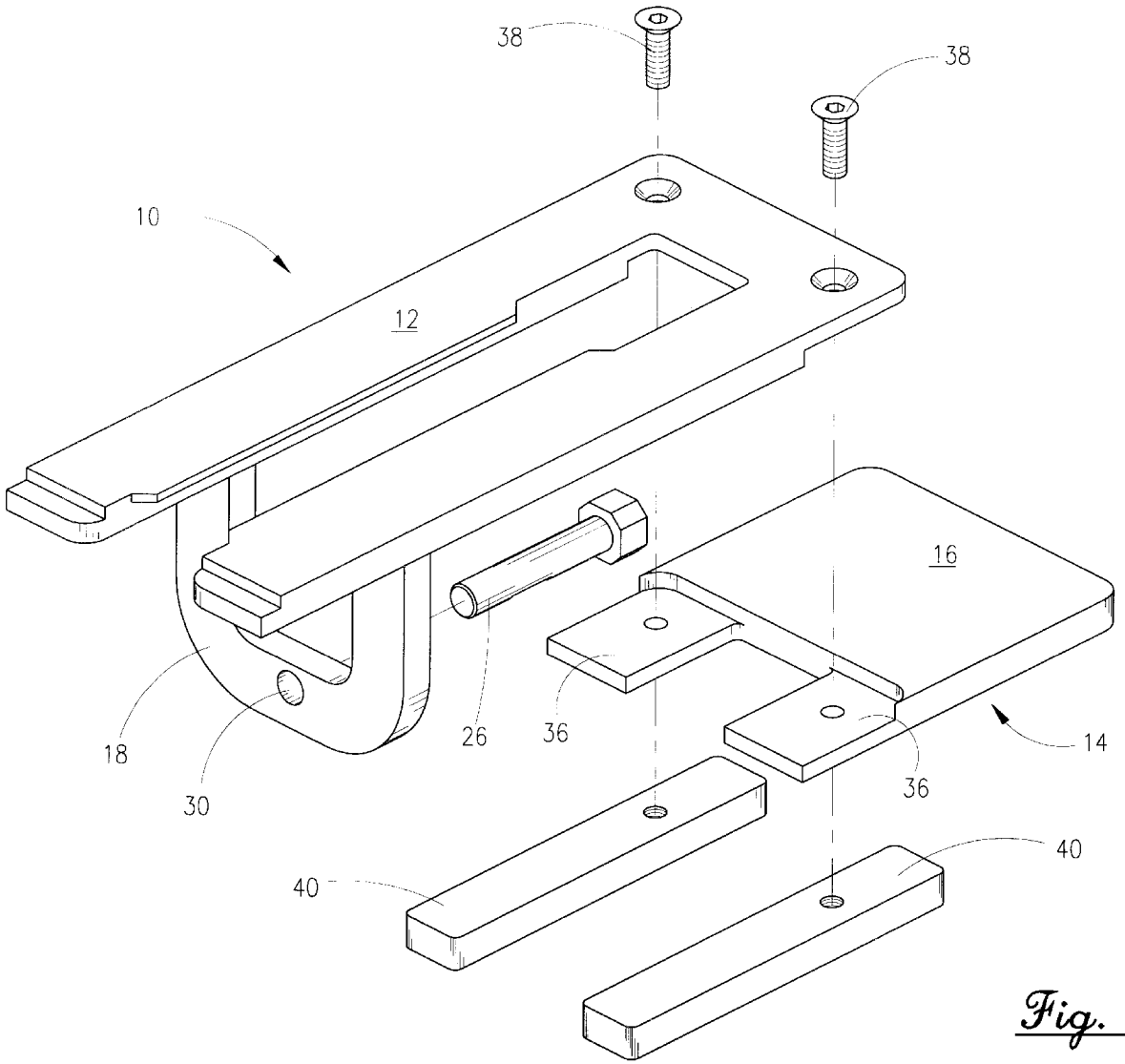
FIG. 3 is an exploded view of the invention including an extended portion.

A mainframe hoop support 10 shown in FIG. 1 comprises an elongated plate or shelf member having a smooth upper face or surface 12 which adapatably circumscribes an embroidery machine's sewing arm on three sides in a contiguous manner and is supported along each side of the embroidery machine's sewing arm by ledges 22 extending along each side of the central slot 20 in the mainframe 10 thus providing planar support on all sides for round sewing hoops generally placed over an embroidery machine's sewing and bobbin plate and around the needles. The mainframe 10 is further supported by engagement steps 24 located along its leading edge at the ends adjacent the central slot 20, which mate with cooperative steps in certain embroidery machines, exposed as a result of the machine's flat, table top being removed to allow bulky and tubular goods to be embroidered by being placed over the machine's exposed sewing arms. A U-shaped, vertical support member 18 extends downwards from the underside of the mainframe 10, spanning the central slot 20. Thereby serving to retain the mainframe support portions 34 located either side of the central slot 20 in ridged alignment and further as a support bracket for attachment to the embroidery machine. The U-shaped vertical member 18 is provided with a mounting pin 26, seen in FIG. 2, slidable through a hole 30 centrally located in the lower portion of the U-shaped member 18. The pin 26 and its location is configured to mate with a socket generally provided for retaining attachments such as a cap attachment to the embroidery machine. A notch 28 located on the sliding pin 26 serves to override an embroidery machine's sensors so as not to restrict the machine's sewing field. The hoop support 10 as shown in FIG. 2 is thereby a cantilever beam engaging the machine at one end by the steps 24, supported by the vertical support 18 the ledges 22 shown in FIG. 1 and secured to the machine by the sliding pin 26 which is retained by an existing screw. In some cases an elongated hoop is required for certain embroidery designs. In such cases an extension support 14 as shown in FIG. 3 may be required which extends the mainframe support 10. The extension support 14 being dimensionally equal to that of the mainframe support 10 except for length. The mainframe support 10 and the extension support 14 are joined at corresponding but opposite steps 36 on each support member 10,14 and secured with countersunk screws 38 in a manner which provides a generally nonperceptible, smooth transition joint along the support's faces 12, 16. A pair of threaded reinforcing blocks or backing bars 40 are also provided to maintain structural rigidity of the stepped joint 36 by be secured across the joint 36 with screws 38.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not intended to limit the invention.

What is claimed is:

1. A tubular goods, hoop support frame attachment for an embroidery machine comprising:

a) a bifurcated, elongated, hoop support shelf said hoop support shelf being a cantilever beam having a smooth upper face;

b) a U-shaped support member secured to a face of said hoop support member opposite said smooth upper face, spanning said bifurcated portion; and c) a pin means slidable in an opening in said U-shaped support member for cooperative engagement with said embroidery machine.

2. A tubular goods, hoop support frame attachment for an embroidery machine according to claim 1 wherein said pin means further comprises a head portion and a notched portion.

3. A tubular goods, hoop support frame attachment for an embroidery machine according to claim 1 wherein said frame attachment further comprises a demountable extension member also having a smooth upper face, said extension member and said hoop support, frame having stepped, cooperative portions located in a contiguous manner whereby when matingly joined form a generally nonperceptible joint between said smooth upper faces.

4. A tubular goods, hoop support frame attachment for an embroidery machine according to claim 3 wherein said extension member and said hoop support frame are secured to each other by passing screws through said stepped cooperative portions into threaded backing bars spanning said joint.

5. An embroidery machine hoop support attachment for tubular goods comprising;

a) an elongated, mainframe member having distal and proximate ends and a smooth upper face, said mainframe member having a slot therein open at said distal end;

b) a step located along each said distal end and at said proximate end;

c) a ledge located along a portion of each linear, inner edge of said slot nearest said smooth face;

d) a U-shaped support member perpendicularly attached to said mainframe member located opposite said smooth face, thereby forming an arch across said slot; and e) a pin, slidable through a hole in said U-shaped support member, having head and notched portions.

6. An embroidery machine hoop support attachment for tubular goods according to claim 5 wherein said mainframe member further comprises;

a) an elongated extension frame member having distal and proximal ends and a smooth upper face, said extension frame member being dimensionally equal to said mainframe member except for length, and stepped at its distal end in a manner for mating with said stepped proximate end of said mainframe member; and b) a fastening means for securing and structurally bracing the joining of said extension frame member to said mainframe member.

7. A method for adapting an embroidering machine to sew tubular goods comprising the steps of:

a) removing said embroidery machine's flat goods support table thereby exposing said machine's sewing arm, needle and bobbin plate;

b) Installing a hoop support attachment comprising;

i) a bifurcated, elongated, hoop support member said hoop support member being a cantilever beam having a smooth upper face;

ii) an attachment member secured to a face of said hoop support member opposite said smooth upper face, spanning said bifurcation portion;

iii) a pin means slidable within an opening within said attachment member, for cooperatively, securing said hoop support member to said embroidery machine; and iv) an extension member contiguous and attached to said hoop support member;

c) attaching said hoop support attachment to said embroidery machine in a manner whereby said attachment is slidably engaged along said machine's exposed, sewing arm thereby providing a hoop support surface surrounding said sewing arm's needle and bobbin plate;

d) supporting said hoop attachment by inserting one end of said hoop attachment under a cooperative ledge located adjacent said sewing arm exposed as a result of removing said flat goods support table;

e) Inserting said pin means into a receiving sleeve normally provided on such embroidery machines for receiving attachments, and f) securing said pin means to said receiving sleeve in a manner whereby said pin means, overrides sewing field sensors located in said embroidery machine.

8. The method according to claim 7 further including the step of: surrounding said sewing arm with a smooth surface extending only a sufficient distance either side of said sewing arm to support a relatively small sewing hoop, said hoop support attachment being flush with said needle plate.

9. The method according to claim 8 further comprises the step of:

extending said hoop support attachment longitudinally by adding said extension support member thus providing said hoop support member with a smooth surface extending a sufficient distance, beyond said hoop support member, to support a relatively small elongated sewing hoop, said extension support member being flush with said hoop support attachment.

* * * * *